US005374042A

United States Patent [19]

Ring

[11] Patent Number: 5,374,042

[45] Date of Patent: Dec. 20, 1994

[54] PAPER WEB SEPARATOR AND DEFLECTOR

[75] Inventor: Robert S. Ring, Rochester, N.H.

[73] Assignee: Moore Business Forms, Inc., Grand Island, N.Y.

[21] Appl. No.: 141,562

[22] Filed: Oct. 27, 1993

Related U.S. Application Data

[63] Continuation-in-part of Ser. No. 18,302, Feb. 16, 1993, Pat. No. 5,348,278.

[51] Int. Cl.[5] ..... B65H 23/032; G03B 1/50

[52] U.S. Cl. ..... 270/52; 83/156; 226/199

[58] Field of Search ..... 270/4, 5, 10, 32, 43, 270/52, 52.5; 83/107, 156, 86, 89; 226/197, 199; 242/56.2

[56] References Cited

U.S. PATENT DOCUMENTS

| | | | |
|---|---|---|---|
| 263,750 | 9/1882 | Anthony et al. . | |
| 655,355 | 8/1900 | Scott . | |
| 818,655 | 4/1906 | Balze | 270/52 |
| 1,161,476 | 11/1915 | Hoe | 270/5 |
| 1,348,553 | 8/1920 | Dowell | 226/197 X |
| 1,610,671 | 12/1926 | Funk | 226/199 X |
| 1,790,559 | 1/1931 | Swift, Jr. . | |
| 2,214,593 | 10/1940 | Mustin et al. | 493/346 X |
| 2,619,057 | 11/1952 | Ellis, Sr. . | |
| 2,868,539 | 1/1959 | Koons et al. . | |
| 2,991,679 | 7/1961 | Moran | 226/197 X |
| 3,399,884 | 9/1968 | Bahrani . | |
| 3,556,509 | 1/1971 | Crum . | |
| 3,734,487 | 5/1973 | Treff | 270/52 |
| 3,954,213 | 5/1976 | Andersen | 226/199 X |
| 4,068,973 | 1/1978 | Fulk | 270/52.5 |
| 4,179,109 | 12/1979 | Harris . | |
| 4,474,566 | 10/1984 | Meadows et al. . | |
| 4,568,141 | 2/1986 | Antes . | |
| 5,009,486 | 4/1991 | Dobrowolski et al. . | |
| 5,016,801 | 5/1991 | Gilat et al. | 226/197 |
| 5,100,117 | 3/1992 | Hajek et al. | 270/52 |
| 5,104,104 | 4/1992 | Mol . | |
| 5,138,604 | 8/1992 | Umeda et al. . | |
| 5,160,171 | 11/1992 | Gregory et al. . | |
| 5,181,745 | 1/1992 | Jacobsen et al. . | |
| 5,230,501 | 7/1993 | Melton | 270/52.5 X |

FOREIGN PATENT DOCUMENTS

| | | | |
|---|---|---|---|
| 66458 | 5/1980 | Japan | 270/10 |

*Primary Examiner*—Edward K. Look
*Assistant Examiner*—John Ryznic
*Attorney, Agent, or Firm*—Nixon & Vanderhye

[57] ABSTRACT

A compact interstacking web deflector for causing a slit paper web to overlap one side of the web over the other. The web deflector includes an elevated deflector bar skewed to the path of the slit web. The elevated deflector imparts a twists to one of the sections of the slit web as the web section flows downward in a loop between the web slitting device and a burster device. The other web section is twisted in an opposite angle to the first section as the other web section drops downward over a skewed leading edge on the slitter device. The opposing twists imparted to the side-by-side sections causes the web sections to merge towards the centerline of the web path and overlap each other. The twists in the web sections are removed as the sections loop under a pair web loop ledges at the bottom of the web loops. In this manner, the paper webs are superimposed one over the other for subsequent processing. The device allows the slit webs to be stacked one on top of the other and as well as to be offset lengthwise by as much as 50% of the form depth.

7 Claims, 4 Drawing Sheets

PAPER WEB SEPARATOR AND DEFLECTOR

RELATED APPLICATION

This is a continuation-in-part application of commonly assigned U.S. patent application Ser. No. 08/018,302, filed Feb. 16, 1993, now U.S. Pat. No. 5,348,278, issued Sep. 20, 1994, entitled "Paper Web Separator and Stacking Apparatus" filed by Robert Ring and which is incorporated by reference here.

TECHNICAL FIELD

The invention relates to web separation and stacking devices. In particular, the invention relates to an interstacking device that slits a web into side-by-side sections and superimposes these sections one over the other.

DESCRIPTION OF THE RELATED ART

Some paper webs are printed in multiple longitudinal sections. For example, front and back sheets of a mailer envelope may be printed side by side on a single web. Similarly, duplicate copies of a business form may be printed adjacent each other on a web. At some point in the processing of the mailer and business form, the side-by-side sections of the web are separated and superimposed one on top of the other. In particular, the adjacent front and back sections of the envelope are slit longitudinally and superimposed together so that the front and back of the envelope can be sealed together. Similarly, the side-by-side business forms are slit and superimposed together to form a carbonless multiple copy form.

In the past it has proven problematic to slit a web longitudinally, separate the adjacent web sections, and superimpose the two sections. Slitting the web presents few difficulties, but superimposing the slit web sections is difficult. Once the web is slit along its centerline, the two sections are separated and twisted to move one section over the other. Once the sections have been aligned one over the other, the webs are again twisted to bring them back together in an overlying relationship. The twisted webs are difficult to handle and often cause the webs to wrinkle. Wrinkles cause a web to jam in automatic web processing devices. Moreover, tension control on the two twisting webs is often less than satisfactory resulting in tearing and jamming of the webs.

Prior techniques for slitting and stacking side-by-side paper web sections require rollers spaced relatively large distances apart from the other sections of the web handling apparatus. For example, U.S. Pat. No. 2,214,593, entitled "Paper Registering Mechanism" describes skewed deflecting rollers that twist the side-by-side paper webs into a superimposed relationship. Traditionally the vertical gap required by the rollers to twist the webs into alignment has been about four to five feet. In addition, the rollers could superimpose just one side of the web over the other, such as the left side over right, but not right side over the left. The prior art deflection rollers lacked the flexibility to superimpose either right sections over left or left sections over right.

The twists imparted to the webs in the traditional deflecting rollers caused difficulties at the upstream web slitter device and downstream buster device that stacks the superimposed web sections. Twists in the web had a tendency to cause the webs to drift off the tractor feeder devices in the slitter and buster. Prior deflecting rollers were less than satisfactory in requiring large amounts of space, their inability to switch the side of the web that was to overlay the other side, and their tendency to wrinkle the web and the jam web handling devices. There has been a long-felt, unsatisfied need for a compact interstacking web deflector that is reversible and does not cause the webs to wrinkle.

SUMMARY OF THE INVENTION

A web deflecting device has been invented to compactly bring a pair of adjacent sections of a slit web into superimposed registration. The web deflecting device comprises a left-hand and right-hand web slitter, a skewed web deflection edge, and an oppositely skewed web deflection rod elevated above the deflection edge. As the whole web moves towards the web slitter, either the left-hand or right-hand web slitter is engaged to slit the web depending on whether the left-hand side of the web is to overlie the right-hand web side, or vice versa.

After the web is slit, one side of the web flows downward over the deflection edge. Because the edge is skewed to the direction of travel of the web, the slit web section twists as it turns downward over the edge. This twist causes the web side to flow towards the centerline of the whole web path. The opposite web section moves up and over the web deflection rod. Because the rod is skewed at an angle opposite to the edge, the opposite web side is twisted and flows toward the centerline of the whole web path. Because the rod is elevated, the opposite web section overlaps the other web section.

The twists in the slit web sections cause the web sections to move together one over tile other as the web sections flow vertically downward the deflection edge and rod. The twisted web sections loop down and under a pair of web loop ledges that maintain the inverted web U-shaped loop between the web slitter and a burster device.

DESCRIPTION OF DRAWINGS

In the drawings accompanying and forming part of the specification.

DETAILED DESCRIPTION OF THE DRAWINGS

Figure 1:
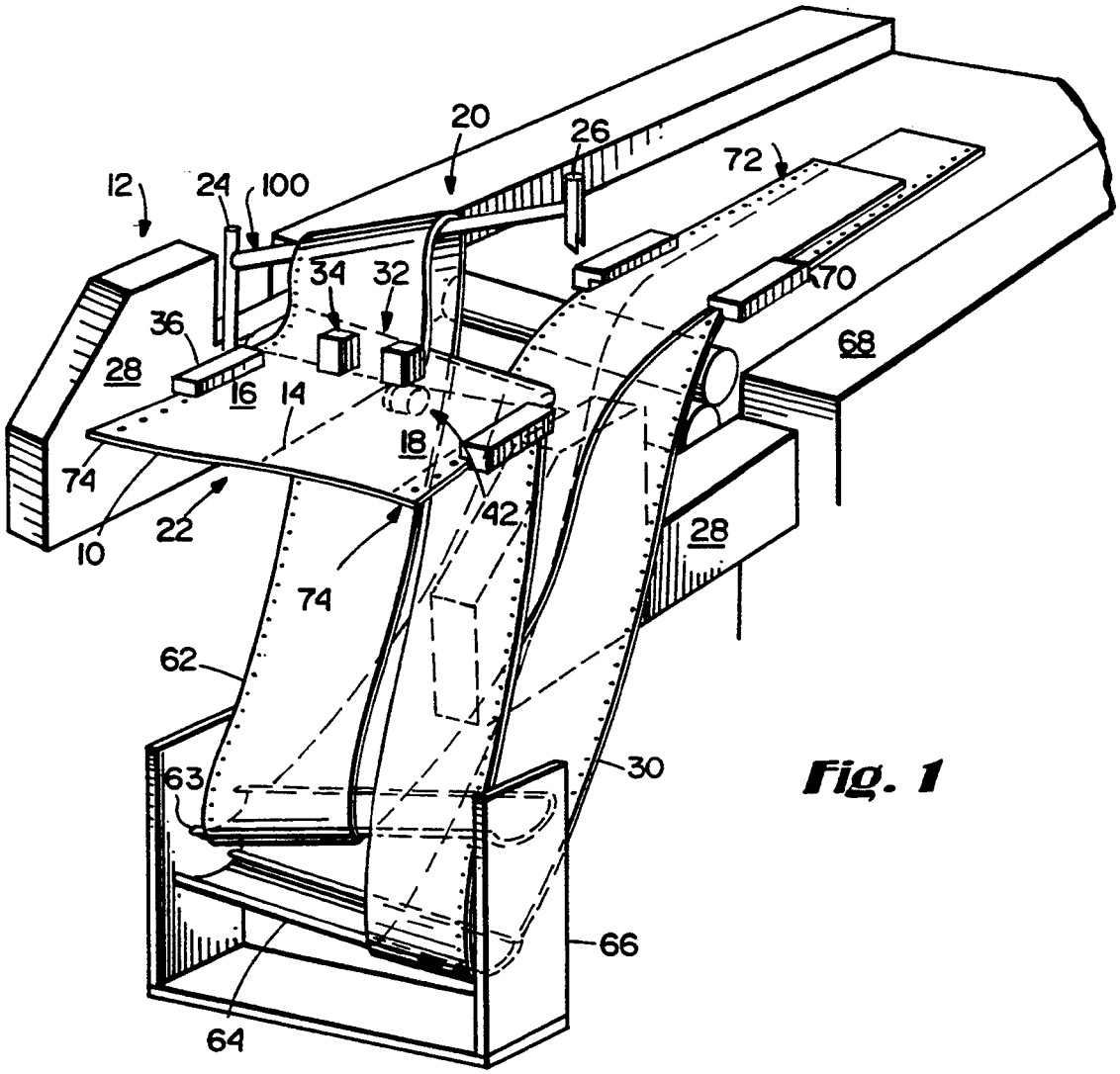
FIG. 1 shows a side perspective view of a paper handling apparatus employing an embodiment of the invention.

FIG. 1 shows a paper handling apparatus for slitting a single paper web 10 longitudinally into two paper web sections 16, 18. The stock paper web 10 is fed into a slitter assembly 12 that cuts the stock web longitudinally into left and right half web sections. As shown in FIG. 1, the slitter cuts the web along the web centerline 14 into a left-hand web section 16 and a right-hand section 18. The slitting operation causes the left-hand web section to flow upwards towards the web deflection rod 100, and the right-hand web section to flow downward over the deflection edge assembly 32.

The web deflection rod 100 is skewed to the path 22 of the web 10. The bar is skewed so that a twist is imparted to the side web section 16 as the section moves up and over the rod. In one embodiment, the rod may be skewed vertically such that it is not horizontal to the web path. In another embodiment, the deflection rod may be horizontally skewed off an angle perpendicular to the centerline 14 of the web. There may be other arrangements of the deflection rod that cause the side web section flowing over the rod to twist towards the centerline of the web.

The web deflection rod is mounted on posts 24 and 26 that are attached to the side housing 28 of the slitter assembly 12. Conventional attachment devices may be used to secure the deflection rod and posts to the side housing. The deflection rod is adjustably mounted so that the rod may be skewed in alternatively orientations to impart desired twists in either the left-hand or right-hand web sections. For example, the mountings of the deflection rod on the posts 24, 26 may be adjustable to cant the rod off a horizontal plane to the left or right. Similarly, the deflection rod skew may be adjusted at the mountings of the posts in the side housing. In another example, the posts 24, 26 may slide into mounting holes in the side housing. In this other example, the skew of the deflection rod is adjusted by pulling the deflection rod and post structure up and out of the mounting holes, turning the structure 180 degrees and sliding the posts, respectively, in the opposite side housing holes.

In the example shown in FIG. 1, the left-hand web section 16 travels over the web deflection rod 100 and twists to the right and the twisted section flows toward the web centerline 14 as the section loops in a U-shaped path 30. In this arrangement, the left-hand web section will overlap the right-hand web section 18, as shown in FIG. 1. If it is desired for the right-hand web section to overlap the left-hand web, then the web deflection rod may be reversed such that the right-hand web loops over the deflection rod 100 and the left-hand web drops downward over the edge assembly 32 of the slitter assembly 12.

Figure 2:
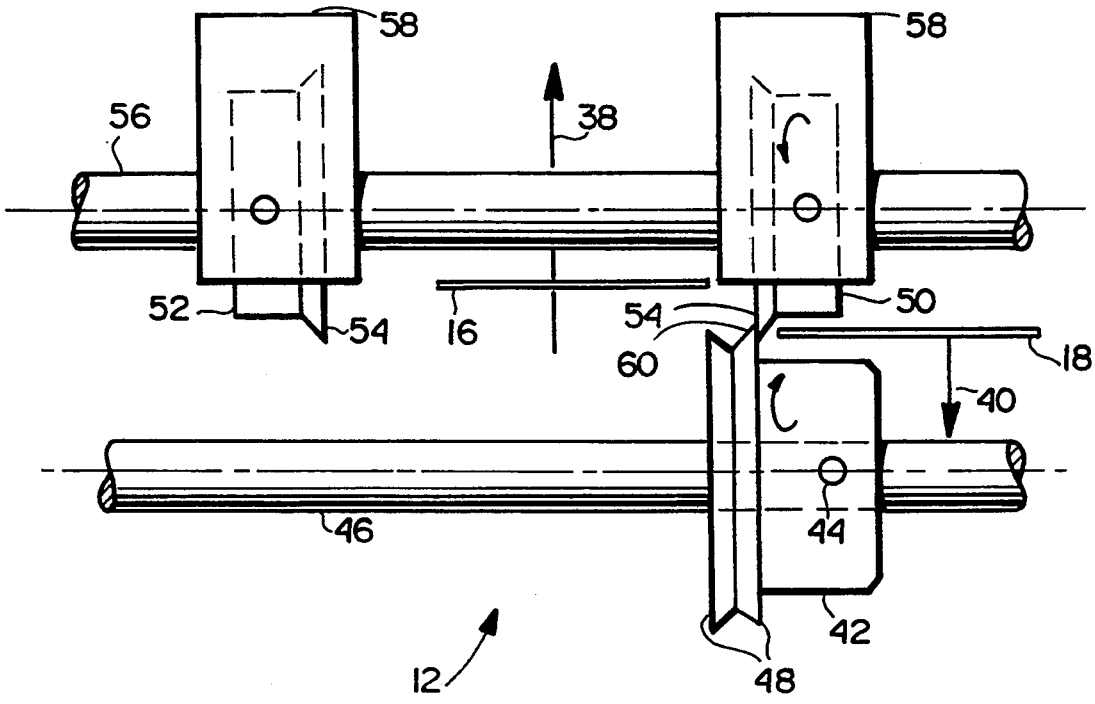
FIG. 2 is a side view of the web slitter cutter hubs of the paper handling apparatus shown in FIG. 1.

The slitter assembly 12 may be relatively conventional with a slitter 34, sidewalls 28 that support the slitter, and tractor feed devices 36 that move the web 10 and maintain web alignment in the slitter. The slitter 34 is best illustrated in FIG. 2 which shows a double slitter arrangement in which the left-hand web section 16 rises upward (38) after being slit and the right-hand web 18 section drops downward (40) after being slit. The slitter includes a lower cutting hub 42 below the web 10 and keyed 44 to a shaft 46 rotatably mounted to the side walls of the slitter assembly. The lower cutting hub has a pair of oppositely facing, beveled cutting rims 48 that act in conjunction with an upper cutting hub to slit the web 10. The lower cutting hub is slidably keyed to its shaft so that the lower hub may be locked into a cutting relationship adjacent a right hand upper slitter 50 or a left-hand upper slitter 52.

The upper slitters 50 52, positioned above the web 10, have beveled cutting rims 54 that abut respective edges of the cutting rim 48 of the lower cutting hub. The upper cutting hubs are also keyed to a rotating shaft 56 that is mounted on the sidewalls of the slitter assembly. The upper hubs are covered by housings 58 for operator safety. Similar to the lower hub, the upper hubs may be slidably keyed to their rotating shaft so that the upper hubs may slide into engagement with the lower hub 42.

The rotating and abutting relationship of the rims of the upper and lower cutting hubs slit the web 10 along a straight line parallel to the path 22 of the web 10. Assuming that the slit point 60 of the upper and lower cutting hubs are aligned with the centerline 14 of the web, then the web will be slit along the centerline of the web. In addition, the slitting action of the cutting hubs cause one section 16 of the slit web to rise upwards and the opposite web section 18 to drop down. As shown in FIG. 2, the left-hand side 16 of the web rises in an upward direction 38 due to the rotational direction of the upper hub. In contrast, the right-hand hub 50 allows the right-hand side 18 of the web to drop in a downward direction 40. Accordingly, the slitting action of the cutting hubs causes one section of the web to rise and the other section to drop. This opposite movement of web sections is used to advantage in that the upward moving web section 16 loops over the elevated deflection rod 100 and the downward moving web section 18 drops over the edge assembly 32 of the slitter.

The twists to the slit web imparted by the web deflector rod and edge cause the right and left web sections to merge together, one section over the other. The left twist imparted in the right web section causes the right web section to move towards the center line 14 of the original web. Similarly, the right twist imparted to the left web section causes it to move towards the center line 14 of the original web.

In a relatively-short distance as the pair of slit webs reach the bottom of their respective loops 30, 62, the slit webs move into substantial superimposed alignment. At the bottom of each web loop is a web loop ledge 63, 64 that ensures that each loop is maintained for a sufficient distance to allow the web sections to overlap and for proper web transfer to be maintained. The ledges are mounted in a bracket 66 such that the ledges can fit readily under the slitter device. In addition, the web loop ledges each impart twists in their respective loops opposite to the twist imparted to each web section by the interstacking web deflector. Accordingly, as the web loops move upward from the ledges, the loops have no twist and are superimposed one over the other.

The web loops enter a specialized burster device 68 which aligns the slit web sections one over the other in a longitudinal 50% offset arrangement so that the webs can be alternately burst. The burster may grasp the superimposed web sections by tractor feed devices 70 on either side of the web sections. The burster continues processing of the superimposed web loops. For example, the superimposed webs can be made into multiply business forms or other products. The burster is a specialized burster device such as that offered by assignee Moore and described in commonly assigned, copending application Ser. No. 08/123,971, entitled "Apparatus and Methods for Bursting Interstacked Longitudinally Offset Form Sets From Continuous Webs", incorporated by reference. The device also allows the individual webs to be stacked one over the other and aligned lengthwise to be burst as two page sets as opposed to bursting alternate top and bottom webs into single page sets.

As the web sections enter the burster 68, the left-hand (16) and right-hand (18) web sections each have respectively a single marginal column of tractor feed holes 72 that engage the tractor feeder 70 of the burster. The burster may also trim the web margins 74 with the tractor feed holes from their respective web section.

As shown in FIG. 1, the downwardly flowing web section, shown as the right-hand section 18, turns downward over edge assembly 32. The edge assembly is mounted in the slitter assembly 12 between the sidewalls 28 in a horizontal plane immediately below the path 22 of the web 10.

Figure 3:
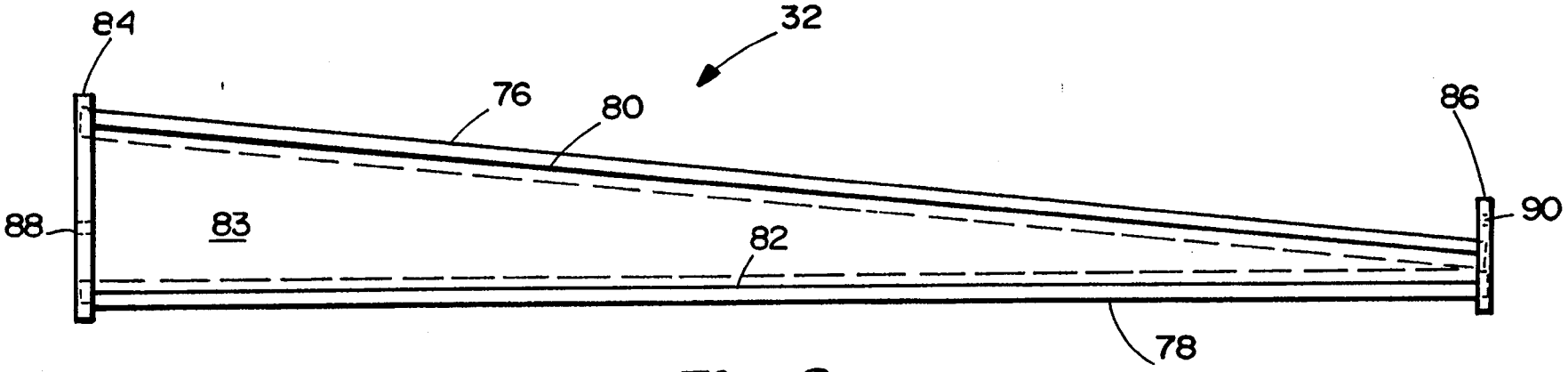
FIG. 3 is a top view of the web deflection edge assembly of the paper handling apparatus shown in FIG. 1.
Figure 4:
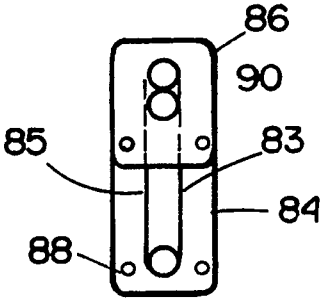
FIG. 4 is a side view of the web deflection edge assembly shown in FIG. 3.

FIGS. 3 and 4 show in detail the edge assembly 32 of the slitter 12. The leading edge 76 and trailing edge 78 of the edge assembly are formed by a pair of rods 80 and 82, respectively. Both rods are held together by a pair of bracket plates 84 and 86. The bracket plates hold the rods in a plane, but the leading edge rod 76 is skewed with respect to the trailing edge rod 82 in this plane. The trailing edge rod is mounted perpendicular to the bracket plates. A triangular metal plate 83 may be welded to the top of the leading and trailing edge rods to provide a smooth surface between the rods for the web section to pass over. A similar metal plate 85 may be applied to the bottom of the edge rods.

The rods are welded at their outer ends to the bracket plates. Each bracket plate 84, 86 is a rectangular metallic plate that is mounted onto the sidewalls 28 of the sillier. When mounted on the sidewalls, the bracket plates hold the edge rods 80, 82 in a horizontal plane, underneath the web 10. The holes 88 and 90 in the brackets lit into corresponding pins on the slitter. The edge assembly 32 may be mounted in the slitter 12 such that the leading edge 76 is skewed to the right, as shown in FIG. 3, to impart a twist in a right-hand web section 18 as implied in FIG. 1. Alternatively, the edge assembly 32 may be reoriented 180 degrees in the slitter 12 so that the leading edge is skewed to the left to impart a twist in the left-hand web section 16.

Figures 5, 6:
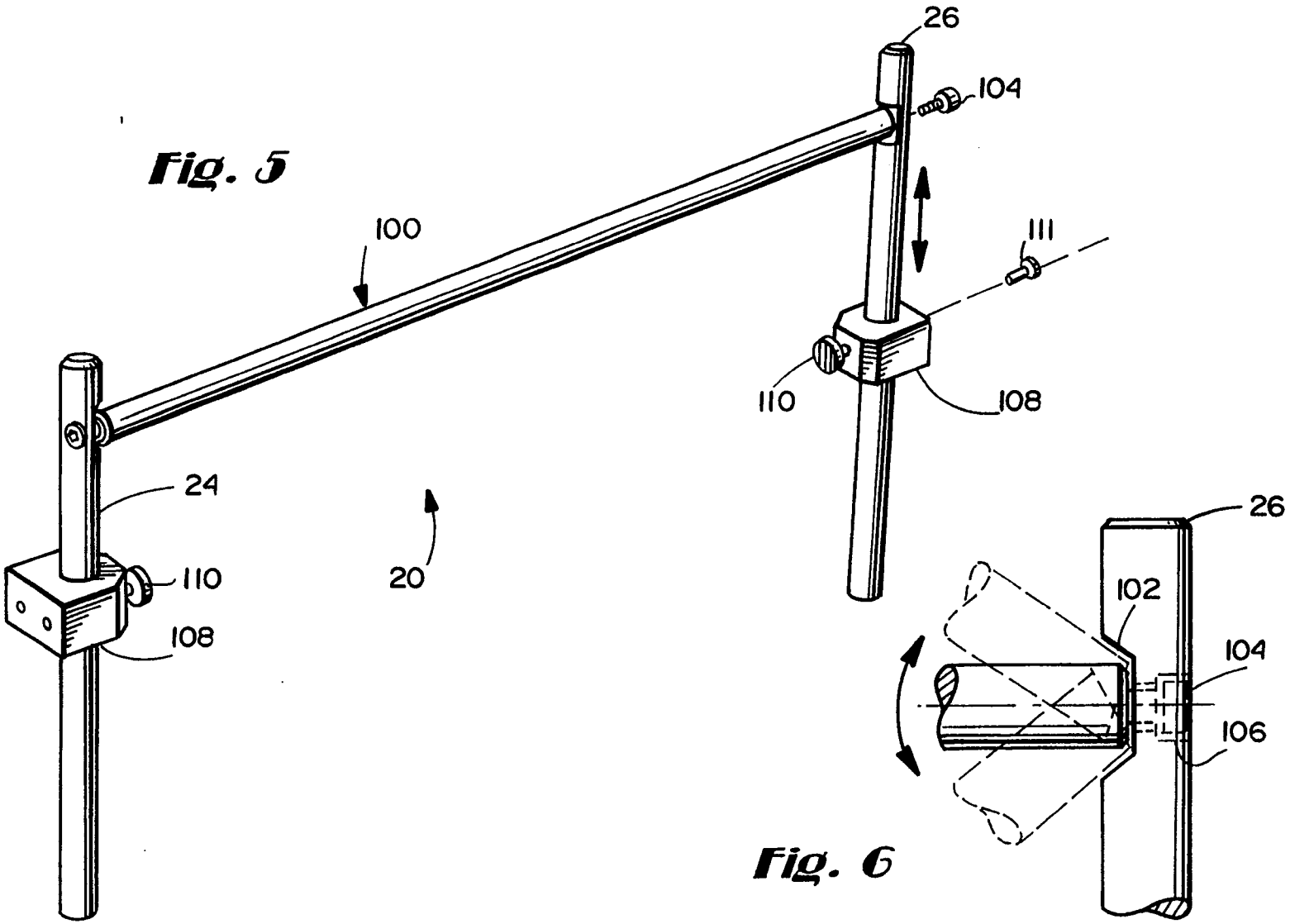
FIG. 5 is a perspective view of the web deflection end assembly shown in FIG. 1.
FIG. 6 is a close-up view of the pivotable mounting of the rod on a post of the web deflection rod assembly shown in FIG. 5.

FIGS. 5 and 6 show an embodiment of the web deflection rod assembly 20 having a rod 100 pivotably mounted at both ends to posts 24, 26. Each post is notched 102 to allow for the range of rotation of the deflection rod. A counter bored hole 106 in the end of each rod receives socket head cap screw 104 that is loosely fastened to rod 100 at each end. The posts are mounted on the walls 28 of the slitter by a block 108 fixed to the slitter wall with screw 111. Each block has a post locking screw 110 to latch the post in the block once the deflection rod has been properly oriented.

In operation as shown in FIG. 1, after being slit the right-hand web section 18 folds downward over the edge assembly 32 which has a leading edge 76 that is skewed a few degrees, e.g. 10°, off the centerline 14 of the web path 22. The angle of the leading edge and of the deflection rod 100 are selected depending upon the amount of twist that is desired to be imparted into the web section and the length of the loops 30, 62. The skew of the leading edge imparts a twist in the right-hand web section that causes that section to flow towards the centerline 14 of the web as the web loops down to the web loop ledge 64. Similarly, after being slit, the left-hand web flows upward over the elevated deflection rod 100 that is skewed opposite to the leading edge 76. The skew of the deflection rod also imparts a twist, e.g. 10°, in the left-hand web 16. This twist also causes the left-hand web to flow towards the centerline 14 as the web sections makes a loop 62 between the slitter 34 and the burster 68. Because of the opposite twists imparted to the web sections, the sections overlap as they loop 30, 62 under the web ledges 63, 64 between the slitter and the burster.

The invention has been described in conjunction with its preferred embodiment. However, the invention is not limited to this preferred embodiment. The invention is as broad as that provided by the spirit and scope of the appended claims.

What I claim is:

1. A web handling device comprising a web slitter assembly cutting a moving web into at least a first and second slit web sections;

a web deflector edge downstream of said slit web sections and receiving a slit web section, said web deflector edge having a leading edge skewed to said moving web, said leading edge twisting the first slit web sections as the section passes over said edge;

a web deflector rod downstream of said slit web sections and receiving the second slit web section, said web deflector rod elevated above said web deflector edge and said web deflector rod skewed to said moving web at an angle opposing said leading edge;

wherein said web deflector rod is attached to said slitter assembly via vertical posts that support said deflector rod; and wherein said vertical posts are adjustable to elevate a first end of the rod above a second end and vice versa.

2. A web handling device as in claim 1 wherein said vertical posts elevate a first end of the rod above a second end to skew said rod to the moving web.

3. A web handling device comprising:

a web slitter assembly cutting a moving web into at least a first and second slit web sections;

a web deflector edge downstream of said slit web sections and receiving a slit web section, said web deflector edge having a leading edge skewed to said moving web, said leading edge twisting the first slit web section as the section passes over said edge;

a web deflector rod downstream of said slit web sections and receiving the second slit web section, said web deflector rod elevated above said web deflector edge and said web deflector rod skewed to said moving web at an angle opposing said leading edge, and wherein said web handling device further comprises a pair of web ledges positioned downstream of said slit web sections, and a first ledge of said pair extending through a loop of said first slit web and said first ledge skewed at an opposite angle to said web deflector edge, and a second ledge of said pair extending through a loop of said second slit web and said second ledge skewed at an opposite angle to said deflector rod.

4. An interstacking web deflector comprising:

a web slitter having a pair of web cutting hubs arranged in a cutting relationship with respect to a web path, a rotating first hub of the hub pair below said web path, and a second hub above said web path and rotating in a direction opposite to said first hub, wherein the rotation of the hubs throws a first web section of a split web in an upward direction and a second web section of the split web in a downward direction;

a deflection rod elevated above said web slitter and over which said rod the first web section passes, and said rod being skewed to the direction of travel of said web path;

a deflection edge on said web slitter over which said second web turns in a downward direction after being slit, and the deflection edge being skewed to the direction of travel of said web path.

5. An interstacking web deflector as in claim 4 wherein said deflection rod imparts a twist to said first web section that redirects the path of said web section towards a centerline of said web path.

6. An interstacking web deflector as in claim 4 wherein said deflection edge imparts a twist to said second web section that redirects the path of said web section towards a centerline of said web path.

7. An interstacking web deflector as in claim 4 wherein said deflection rod imparts a twist to said first web section that redirects the path of said web section towards a centerline of said web path and wherein said deflection edge imparts a twist to said second web section that redirects the path of said web section towards a centerline of said web path, such that said first and second web sections merge to an overlap relationship.

* * * * *